United States Patent [19]

Sweany et al.

[11] 4,104,628

[45] Aug. 1, 1978

[54] HIGH OUTPUT AUDIBLE ALARM DEVICE UTILIZING A PIEZOELECTRIC TRANSDUCER AND VOLTAGE DOUBLING MEANS

[75] Inventors: Louis P. Sweany, Carmel; Michael T. Burk, Indianapolis, both of Ind.

[73] Assignee: P.R. Mallory & Co. Inc., Indianapolis, Ind.

[21] Appl. No.: 732,884

[22] Filed: Oct. 15, 1976

[51] Int. Cl.[2] ..... G08B 3/00

[52] U.S. Cl. ..... 340/384 E; 340/384 R

[58] Field of Search ..... 340/384 E, 384 R; 331/112, 174, 116

[56] References Cited

U.S. PATENT DOCUMENTS

| | | | |
|---|---|---|---|
| 3,138,795 | 6/1964 | Wallace | 340/384 E |
| 3,284,796 | 11/1966 | Borsattino | 340/384 E |
| 3,541,548 | 11/1970 | Cogar | 340/384 R |
| 3,559,158 | 6/1971 | Bettcher | 340/384 E |
| 3,890,612 | 6/1975 | Sweany | 340/384 E |
| 3,893,107 | 7/1975 | Schedler | 340/384 R |
| 3,922,672 | 11/1975 | Birt | 340/384 E |
| 4,018,131 | 4/1977 | Cannon | 340/384 E |

*Primary Examiner*—Harold I. Pitts

*Attorney, Agent, or Firm*—Hoffmann, Meyer & Coles

[57] ABSTRACT

A piezoelectric transducer and a voltage doubling means are utilized in conjunction with a power supply means, a pulsator means, an amplifier means, and an acoustical loading means to produce an efficient high output audible alarm device. The voltage doubling means and the acoustical loading means enhance the audible output of the alarm device while increasing the overall electroacoustical efficiency of the alarm.

6 Claims, 2 Drawing Figures

HIGH OUTPUT AUDIBLE ALARM DEVICE UTILIZING A PIEZOELECTRIC TRANSDUCER AND VOLTAGE DOUBLING MEANS

BACKGROUND OF THE INVENTION

Generally speaking, the present invention relates to audible alarm devices and more specifically, audible alarm devices that utilize piezoelectric transducers of the type that convert electrical energy into sound energy wherein an acoustical loading means in spaced relation to a piezoelectric transducer and a voltage doubling means electrically coupled to circuitry including a power supply means, a pulsator means responsive to the power supply means and an alarm means electrically coupled to the pulsator means produce an efficient high output audible alarm.

Audible alarm devices utilizing piezoelectric transducer are in common use in many different applications requiring an audible warning signal including fault alarms, fire and smoke detection signals, and monitors for medical instruments. In many other applications including some intrusion alarms and in general applications requiring high outputs, piezoelectric alarm devices have not previously been used because they do not generally produce a sufficiently high volume of sound output for the application. Also, minimum standards are now being set for sound output of alarms utilized in such applications as fire and smoke detectors; accordingly, if piezoelectric transducers are to continue to be used in such applications, an increase in sound volume will be necessary. Previous work toward the objective of producing a volume level of sound higher than can be achieved in alarm devices utilizing piezoelectric transducers of the same size can be found in Sweany et al, U.S. Pat. No. 3,890,612 dated June 17, 1975. An embodiment of the present invention improves upon the Sweany patent by utilizing a voltage doubling means and an aperture terminated resonant cavity in combination with a piezoelectric transducer having three electrodes (previously disclosed in Sweany, U.S. Pat. No. 3,815,129 dated June 4, 1974) and an integrated circuit packaged (previously disclosed in Birt et al. U.S. Pat. No. 3,922,672 dated Nov. 25, 1975). As a result of the use of integrated circuitry and a voltage doubling means the weight and size of the present invention are significantly less than the device disclosed in Sweany et al., U.S. Pat. No. 3,980,612. This design feature and others increase the applicability of the present invention over devices of similar function.

Accordingly, a feature of the present invention is to provide an improved high output audible alarm device that utilizes a piezoelectric transducer of the type that converts electrical energy into sound energy. Another feature of the present invention is to provide a high output audible alarm device with reduced weight and size to that of conventional audible alarm devices. Another feature of the present invention is to provide an audible alarm system yielding a highly efficient alarm which is compatible with logic circuitry. Another feature of the present invention is to provide a high output audible alarm device for applications where low voltage power supplies are desired or mandatory. Yet another feature of the present invention is to provide an audible alarm device that includes a piezoelectric transducer, an amplifier means, a pulsator means and a power supply means cooperating with a voltage doubling means to produce a pulsating high output audible alarm. Yet another feature of the present invention is to provide a high output audible alarm device including a piezoelectric transducer in spaced relation to an acoustical loading means in combination with an amplifier means, a pulsator means, and a power supply means. Still another feature of the present invention is to provide a high output audible alarm device including a piezoelectric transducer in spaced relation to an acoustical loading means in combination with a voltage doubling means, an amplifier means, a pulsator means, and a power supply means. These and other features of the invention will become more apparent from the following description taken in conjunction with the accompanying drawings which follow:

DESCRIPTION OF THE PREFERRED EMBODIMENT

Figure 1:
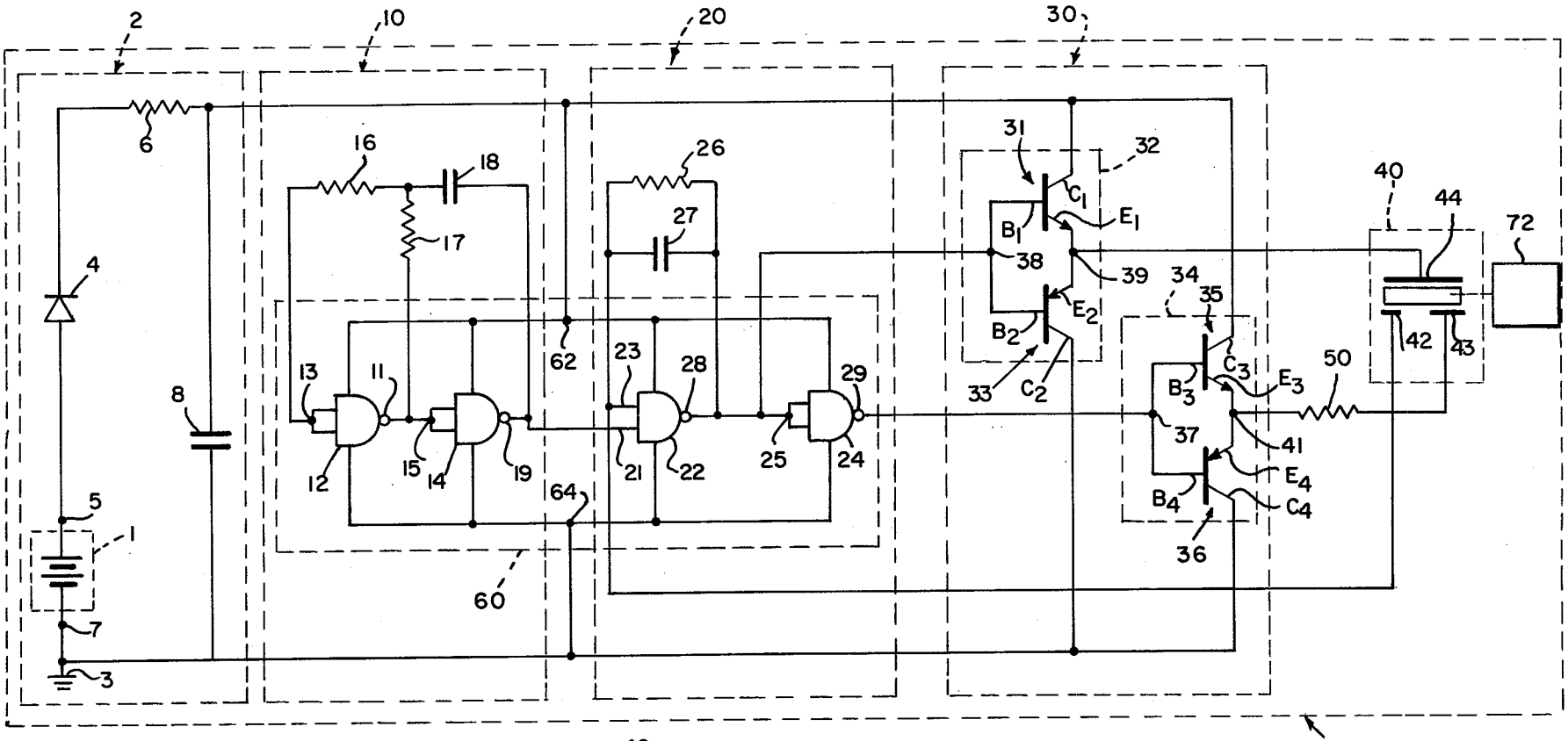
FIG. 1 is a wiring diagram of a high output audible alarm device utilizing a piezoelectric transducer and voltage doubling means.

Referring to FIG. 1 an audible alarm device 70 includes a power supply means 2, a pulsator means 10, an amplifier means 20, a voltage doubling means 30, a piezoelectric transducer 40, and an acoustical loading means 72.

Power supply means 2 includes a low voltage DC power supply 1 which may be a low voltage battery having its positive side 5 connected in series with a diode 4, a resistor 6, and a capacitor 8 and its negative side 7 connected to a grounding means 3.

Pulsator means 10 for producing pulsations and reducing power consumption in an audible alarm device 70 includes two two-input NAND gates 12 and 14 of a Quad-two-input NAND gate integrated circuit package 60. One such integrated circuit package 60 is encased in a 14 terminal dual-in-line plastic module manufactured by National Semiconductor Company of Santa Clara, California. A common input 13 of NAND gate 12 is connected to a first side of a resistance means 16. A common input 15 of NAND gate 14 is connected to the first side of resistance means 17 and an output 11 of gate 12. An output 19 of gate 14 is connected to amplifier means 20 and to a first side of capacitance means 18. A second side of resistance means 16 is connected to a second side of resistance means 17 and a second side of capacitance means 18.

Amplifier means 20 includes two two-input NAND gates 22 and 24 of a Quad two-input NAND gate integrated circuit package 60. An input 21 of NAND gate 22 is connected to pulsator means 10. An input 23 of NAND gate 22 is connected to a first side of a parallel combination of a resistance means 26 and capacitance means 27 and to an electrode 42 of piezoelectric transducer 40. An output 28 of NAND gate 22 is connected to a second side of the parallel combination of resistance means 26 and capacitance means 27, to a common input 25 of NAND gate 24 and to voltage doubling means 30. An output 29 of NAND gate 24 is also connected to voltage doubling means 30.

A plus voltage terminal 62 of integrated circuit package 60 is connected to positive side 5 of power supply means 2 through resistance means 6 and diode 4. A minus voltage terminal 64 of integrated circuit package 60 is connected to grounding means 3.

Voltage doubling means 30 for providing a drive voltage to piezoelectric transducer 40 which is substantially double the input voltage of power supply means 2 includes two bipolar buffer amplifiers 32 and 34. Bipolar buffer amplifier 32 includes an NPN transistor 31 and a PNP transistor 33. The base $B_1$ of transistor 31 and the base $B_2$ of transistor 33 are electrically coupled to form a common base connection 38. The common base connection 38 of bipolar buffer amplifier 32 is connected to an output 28 of NAND gate 22. The emitter $E_1$ of transistor 31 and the emitter of $E_2$ of transistor 33 are electrically coupled to form a common emitter connection 39. The common emitter connection 39 of bipolar buffer means 32 is connected to electrode 44 of piezoelectric transducer 40. The collector $C_1$ of transistor 31 is connected to the positive side 5 of power supply means 2 through resistance means 6 and diode 4 and the collector $C_2$ of transistor 33 is connected to grounding means 3. Bipolar buffer amplifier 34 includes an NPN transistor 35 and a PNP transistor 36. The base $B_3$ of transistor 35 and the base $B_4$ of transistor 36 are electrically coupled to form a common base connection 37. The common base connection 37 of bipolar buffer amplifier 35 is connected to an output 29 of NAND gate 24. The emitter $E_3$ of transistor 35 and the emitter $E_4$ of transistor 36 are electrically coupled to form a common emitter connection 41. The common emitter connection 41 of bipolar buffer means 34 is connected to electrode 43 of piezoelectric transducer 40 through a resistance means 50.

Piezoelectric transducer 40 operates at substantially resonant frequency and is therefore a piezo resonant transducer. Piezoelectric transducer 40 includes three electrodes 42, 43 and 44 wherein electrode 42 provides a coupling for a feedback loop which is connected to an input 23 of NAND gate 22.

In operation, power supply means 2 provides a low input voltage to an audible alarm device 70. Such voltage must be sufficient to drive pulsator means 10 and amplifier means 20. Diode 4 is a blocking diode, resistance means 6 is a current limiting device, and capacitance means 8 is a storage capacitor to assist in the starting of pulsator means 10 and amplifier means 20.

In pulsator means 10, first and second NAND gates 12 and 14 respectively, cooperate with resistor 17 and capacitor 18 to cause the voltage at output 19 to alternately rise and fall in essentially a square wave manner at a repetition rate controlled by the values of resistor 17 and capacitor 18.

In amplifier means 20, NAND gates 22 and 24 respectively, operate as an oscillator capable of driving transducer 40 into vibration near its resonant frequency whereby an audible alarm is produced. Electrode 42 of transducer 40 provides a feedback voltage of a magnitude and phase to permit sustained oscillations in the amplifier means 20. When the voltage supplied from output 19 of NAND gate 14 to input 21 of NAND gate 22 is near the input voltage of power supply means 2 oscillation will occure in amplifier means 20. When voltage from output 19 is near ground potential the oscillations cease. NAND gate 22 is linearized by resistance means 26 and capacitance means 27 provides an attenuation of spurious signals appearing at the input of NAND 22 which may be either external or within the feedback voltage coming from transducer 40.

Since the sound pressure level emitted by transducer 40 operating at substantially resonant frequency is a direct function of the voltage applied across it, voltage doubling means 30 allows the voltage applied across transducer 40 to be substantially double the input voltage of power of supply means 2 thereby substantially increasing the volume output of audible alarm means 70. Bipolar buffer amplifier 32 and 34 are capable of supplying output pulse signals corresponding to either a positive or negative input signal. As buffers, amplifiers 32 and 34 isolate amplifier means 20 from effects of variations in the impedance of transducer 40 on the outputs of NAND gates 22 and 24 and in addition provide a low impedance drive source for transducer 40. Outputs 28 and 29 of NAND gates 22 and 24 respectively, provide simultaneous pulse signals of opposite polarities to bipolar buffer amplifiers 32 and 34 respectively. Pulse signals having negative polarities switch on NPN transistors 31 and 35 and pulse signals having positive polarities switch on PNP transistors 33 and 36. Accordingly, the output signals of bipolar buffer amplifiers 32 and 34 appearing at electrodes 44 and 42 respectively of transducer 40 are swinging from positive to negative polarity. Because of the shunting capacitor properties of transducer 40, the instantaneous vector sum of the two voltages appearing at electrodes 44 and 42 is equal to substantially double the input voltage of power supply means 2. Accordingly, by utilizing voltage doubling means 30 the power applied to transducer 40 is substantially four times that of power supply means 2. Also, because of the inherent capacitance of transducer 40, resistance means 50 is connected in series with transducer 40 to limit instantaneous current peaks which occur when the polarities of the voltage across transducer 40 are suddenly reversed.

Figure 2:
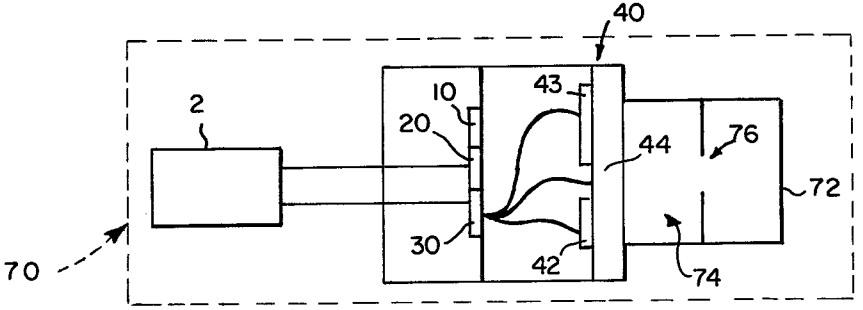
FIG. 2 is a sectional elevation view of a high output audible alarm device.

Referring now to FIG. 2 an audible alarm device 70 includes an acoustical loading means 72 which, in the illustrated embodiment, comprises an aperture termination 76 in spaced relation to the piezoelectric transducer 40 and a resonant cavity 74 coupled to the transducer 40. For purposes of this disclosure the term aperture termination shall mean a load coupled to the audible output of piezoelectric transducer 40 comprising an opening through which sound waves can pass and the term resonant cavity shall mean a space totally or partially enclosed having a predetermined resonant frequency. Acoustical loading means 72 provides acoustic coupling of the audible output of the transducer 40 to the surrounding environment. In operation, the audible output of piezoelectric transducer 40 is intensified by exciting resonant cavity 74 to its resonant frequency and acoustically matched to the air mass of the environment surrounding the alarm device 70 by means of an aperture termination 76 thereby increasing the overall electroacoustical efficiency of the alarm device 70.

What is claimed is:

1. In a high output audible alarm device comprising a power supply means, a pulsator means responsive to said power supply means for producing pulsations in said audible alarm device, an amplifier means electrically coupled to said pulsator means for oscillating said power supply input voltage, and a piezoelectric transducer responsive to said amplifier means, the improvement comprising a means simultaneously responsive to a plurality of electrical pulses of opposite polarities for doubling the voltage of said power supply means whereby a drive voltage is supplied to said piezoelectric transducer which is double said power supply means input voltage.

2. The audible alarm device as recited in claim 1 wherein said voltage doubling means includes at least two bipolar buffer amplifiers one of which is electrically coupled to a first output of said amplifier means and a first electrode of said piezoelectric transducer and another of which is electrically coupled to a second output of said amplifier means and a second electrode of said piezoelectric transducer.

3. The audible alarm device as recited in claim 2 wherein at least one of said bipolar buffer amplifiers includes an NPN transistor and a PNP transistor having a common base connection and a common emitter connection.

4. The audible alarm device as recited in claim 3 wherein at least one of said bipolar buffer amplifiers is electrically coupled to said amplifier means at said common base connection and is electrically coupled to said piezoelectric transducer at said common emitter connection.

5. A high output audible alarm device comprising, in combination a power supply means, a pulsator means responsive to said power supply means for producing pulsations in said audible alarm device, an amplifier means electrically coupled to said pulsator means for oscillating said power supply input voltage, a piezoelectric transducer responsive to said amplifier means, a means simultaneously responsive to a plurality of electrical pulses of opposite polarities for doubling the voltage of said power supply means whereby a drive voltage is supplied to said piezoelectric transducer which is double said power supply means input voltage, and an acoustical loading means in spaced relation to said piezoelectric transducer including an aperture termination.

6. The combination as recited in claim 5 wherein said acoustical loading means further includes a resonant cavity coupled to said piezoelectric transducer.

* * * * *